US006378837B1

(12) United States Patent
Keller

(10) Patent No.: US 6,378,837 B1
(45) Date of Patent: Apr. 30, 2002

(54) REUSABLE CONCRETE SUPPORT FRAME

(76) Inventor: Melvin Keller, 19701 E. 114 St., Broken Arrow, OK (US) 74014

( * ) Notice: Subject to any disclaimer, the term of this patent is extended or adjusted under 35 U.S.C. 154(b) by 0 days.

(21) Appl. No.: 09/843,675

(22) Filed: Apr. 27, 2001

(51) Int. Cl.[7] ..... E04G 11/36; E04G 11/50; E04G 17/18

(52) U.S. Cl. ..... 249/210; 249/211; 249/23; 249/24

(58) Field of Search ..... 249/23, 24, 25, 249/209, 210, 211

(56) References Cited

U.S. PATENT DOCUMENTS

| | | | | | |
|---|---|---|---|---|---|
| 629,636 | A | * | 7/1899 | White | 249/25 |
| 644,986 | A | * | 3/1900 | Lechner | 249/24 |
| 1,270,043 | A | * | 6/1918 | Murphy | 249/211 |
| 1,652,056 | A | * | 12/1927 | Selway | 249/24 |
| 1,888,181 | A | * | 11/1932 | Riesbol | 249/23 X |
| 2,167,413 | A | * | 4/1939 | Bartlett | 249/23 |
| 2,866,252 | A | * | 12/1958 | Cobi | 249/211 |
| 3,004,321 | A | * | 10/1961 | Pulliam | 249/24 |
| 3,045,786 | A | * | 7/1962 | De La Rambelje | 249/210 X |
| 3,689,020 | A | * | 9/1972 | Martin | 249/25 |
| 4,349,491 | A | * | 9/1982 | Eyden | 249/210 X |
| 4,441,685 | A | | 4/1984 | Greeson | |
| 4,756,641 | A | | 7/1988 | Hartzheim | |
| 4,856,252 | A | * | 8/1989 | Cornell | 249/211 X |
| 4,904,111 | A | | 2/1990 | Weisbach | |
| 5,083,739 | A | | 1/1992 | Shook et al. | |
| 5,092,559 | A | | 3/1992 | Tjelle | |
| 5,104,089 | A | | 4/1992 | Shook et al. | |
| 5,271,596 | A | | 12/1993 | Holcomb et al. | |
| 5,651,914 | A | | 7/1997 | Schwörer | |
| 5,755,981 | A | | 5/1998 | Payne | |
| 5,906,076 | A | | 5/1999 | McManus | |

FOREIGN PATENT DOCUMENTS

| | | | | |
|---|---|---|---|---|
| DE | 1534862 | * | 9/1969 | 249/25 |
| GB | 394782 | * | 7/1933 | 249/23 |
| GB | 513676 | * | 10/1939 | 249/210 |

* cited by examiner

*Primary Examiner*—Laura A. Callo
(74) *Attorney, Agent, or Firm*—Molly D. McKay

(57) ABSTRACT

A reusable concrete support frame removably supported by horizontal supporting beams while a concrete slab is poured on top of it to build a bridge. The frame has an angle iron end member at each end of the frame which removably engages the horizontal supporting beams at a slight angle. One of the angle iron end members is welded to two parallel, spaced apart first channel irons, and the other angle iron end member is welded to two parallel spaced apart second channel irons. The first pair of channel irons insert between the second pair and are pivotally secured to them by bolts so that the channel irons articulate relative to their corresponding mating channel irons. The channel irons can be locked together so the frame is horizontal when the concrete is poured and thereafter can be released to pivot or articulate downward to remove the frame for reuse.

3 Claims, 3 Drawing Sheets

REUSABLE CONCRETE SUPPORT FRAME

BACKGROUND OF THE INVENTION

1. Field of the Invention

The present invention relates to a reusable support frame designed to serve as a floor for pouring concrete slabs that will be supported by vertical support beams in order to form a bridge or similar structure.

2. Description of the Related Art

Currently, the most common construction method employed when building a bridge for a roadway is to form up the floor of the road with wooden timbers, pour the concrete slab over the timbers, then remove the timbers after the concrete has hardened sufficiently. The timbers used for this purpose are generally wood planks or plywood.

This type of framing of concrete forms is time consuming and can be dangerous to the workmen who must create and then disassemble the wooden forms. Also, this method of forming is time consuming and expensive in terms of manpower and materials since the wood planks and plywood are often damaged during disassembly of the forms and can not be reused.

The present invention addresses these problems by providing frames that are adjustable to fit different road widths, that can be easily and quickly installed, that are safe from falling once locked into place, that form a strong and uniform floor for pouring cement, and that can be easily and quickly removed without damaging the forms and without endangering the workers. Thus, these forms can be reused multiple times, making them extremely cost effective to use.

SUMMARY OF THE INVENTION

The present invention is a reusable concrete support frame that can be removably supported by horizontal supporting beams while a concrete slab roadbed is poured on top of the frame when building a bridge or other similar structure. The frame has an angle iron end member at each end of the frame which removably engages the horizontal supporting beams. One of the angle iron end members is welded to two parallel spaced apart first channel irons and the other angle iron end member is also welded to two other parallel spaced apart second channel irons. The second pair of channel irons are spaced further apart than the first pair of channel irons so that the first pair insert between the second pair.

Each of first pair of channel irons has a number of bolt openings extending through it can be aligned with an associated bolt opening in the corresponding one of the second pair of channel irons so that the frame can be lengthened or shortened by selecting the appropriate bolt opening to place a bolt into. A nut secures each bolt. The bolt will serve as a pivotal axis so that the first channel irons can pivot or articulate relative to the second channel irons.

One plate is welded to the top surfaces of the first channel irons, a second plate is welded to the second channel irons, and a third plate is pivotally secured to the second plate so that the third plate pivots when the first and second channel irons pivot relative to each other. Together, the three plates form a floor onto which concrete can be poured when the frame is locked in a horizontal position. The plates extending beyond their supporting first and second channel irons so that, when several plates are used sided by side, the plates of one frame are supported by one of the second channel irons of an adjacent frame.

Each of the two angle iron end members is attached to the frame so that a first leg of each of the angle irons members extends outward away from the frame and is angled slightly downward. This makes the other leg, which is oriented downward at a right angle to the first leg, angled slightly off perpendicular. This angled arrangement of the two angle iron end members causes a space at the proximal end of the first legs of the two angle iron end members and at the distal end of the second legs relative to the horizontal support beams. This space allows the frame to be removed from between the horizontal supporting beams and the concrete slab that will eventually be poured on top of the frame.

A horizontal bar is welded or otherwise permanently attached between the first channel irons at one end of the first channel irons. The horizontal bar is provided with a rod that extends outward toward the second angle iron end member. A sliding lock bar extends between the second channel irons and is movable longitudinally along the second channel irons. The sliding lock bar has two unshaped arms that slidably engage the second channel irons so the sliding lock bar is movable. The sliding lock bar includes a tab that extends upward and has a rod-receiving opening in it for removably receiving the rod on the horizontal bar. To lock the frame in a horizontal position, the sliding lock bar is moved toward the first angle iron end member until the rod enters the rod-receiving opening in the tab of the sliding lock bar. With the rod in this position, the frame can not pivot. A locking opening is provided in the rod and a cotter pin can be removably inserted into the locking opening to lock the rod within the rod-receiving opening as a safety precaution against accidental pivoting release of the frame.

The frame can be unlocked so that it pivots or articulates to remove the frame for the horizontal supporting beams and the overlying concrete slab for reuse.

DETAILED DESCRIPTION OF THE PREFERRED EMBODIMENT THE INVENTION

Figure 1:
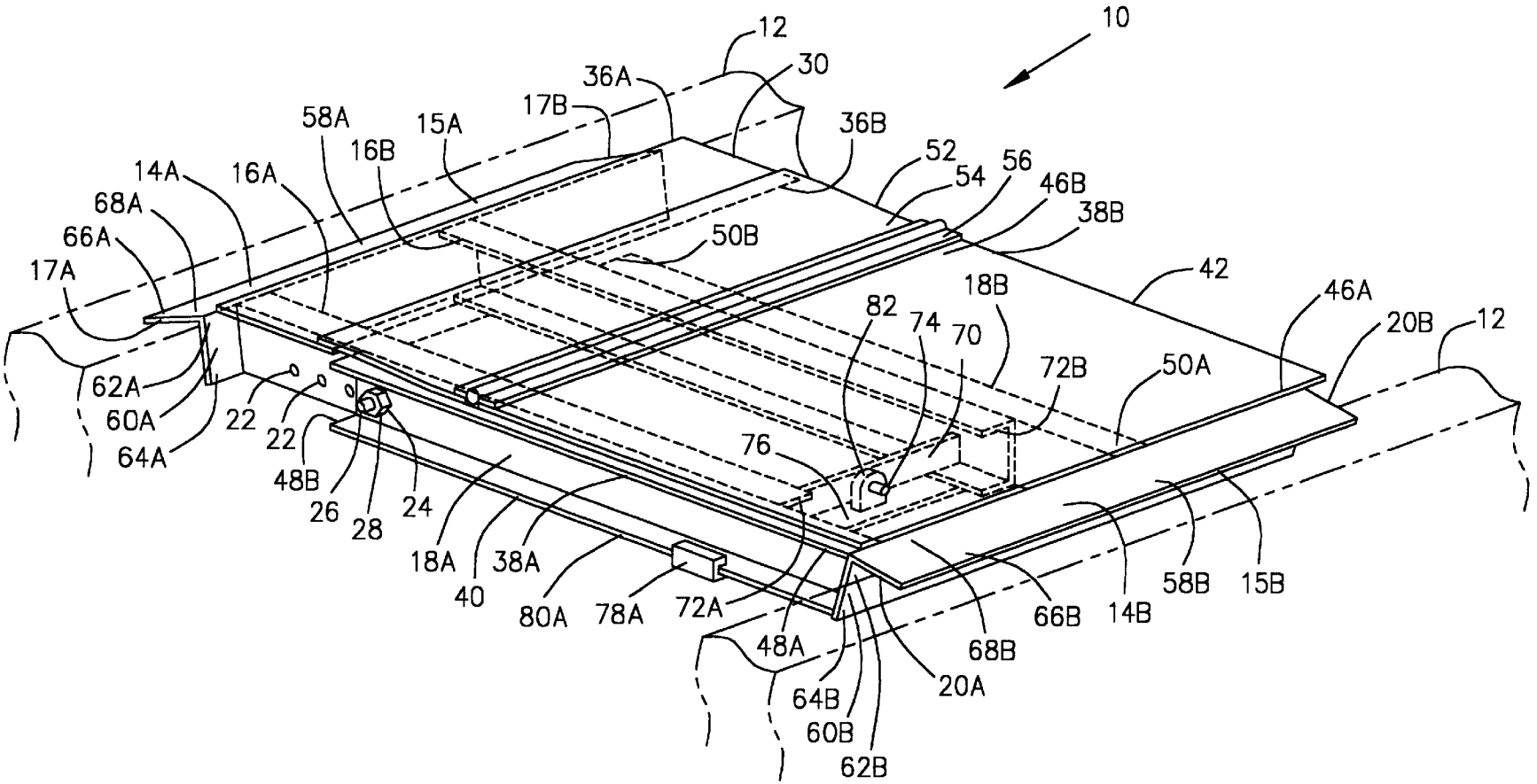
FIG. 1 is a perspective view of a reusable concrete support frame constructed in accordance with a preferred embodiment of the present invention.

Referring now to the drawings and initially to FIG. 1, there is illustrated a reusable concrete support frame 10 constructed in accordance with a preferred embodiment of the present invention. The frame 10 is shown resting on two horizontal supporting beams 12, such as the type of concrete or steel supporting beams that would typically be found supporting a concrete slab roadbed on a bridge or other similar structure.

The frame 10 is provided with two angle iron end members 14A and 14B, one on either end 15A and 15B of the frame 10 by which the frame 10 removably engages and rests upon the horizontal supporting beams 12. The first angle iron end member 14A is welded or otherwise permanently secured to two parallel spaced apart first channel irons 16A and 16B so that the first channel irons 16A and 16B are approximately perpendicular to the first angle iron end member 14A and a first end 19A of the first channel iron 16A is secured close to a first end 17A of the first angle iron end member 14A and a first end 19B of the first channel iron 16B is secured approximately midway between ends 17A and 17B of the first angle iron end member 14A.

Likewise, the second angle iron end member 14B is also welded or otherwise permanently secured to two parallel spaced apart second channel irons 18A and 18B so that the second channel irons 18A and 18B are approximately perpendicular to the second angle iron end member 14B and the first end 48A of the second channel iron 18A is secured close to a first end 20A of the second angle iron end member 14B and the first end 50A of the second channel iron 18B is secured approximately midway between the two opposite ends 20A and 20B of the second angle iron end member 14B.

The second pair of channel irons 18A and 18B are spaced further apart than the first pair of channel irons 16A and 16B so that the first pair 16A and 16B insert between the second pair 18A and 18B.

Each of the first pair of channel irons 16A and 16B is provided with a number of bolt openings 22 extending therethrough and each of the second pair of channel irons 18A and 18B is provided with a single bolt opening 24 extending therethrough. A bolt 26 is inserted through each of the single bolt openings 24 of the second channel irons 18A and 18B and also through one of the bolt openings 22 in the first channel irons 16A and 16B to pivotally secure each of the first channel irons 16A and 16B to a corresponding second channel iron 18A and 18B in a manner similar to the articulation of a human's arm around the elbow. Each bolt 26 is secured with a nut 28. The frame 10 can be shortened or lengthened by inserting the bolts 26 through different bolt openings 22 on the first pair of channel irons 16A and 16B when the first pair of channel irons 16A and 16B are pivotally secured to the second pair of channel irons 18A and 18B.

Figure 5:
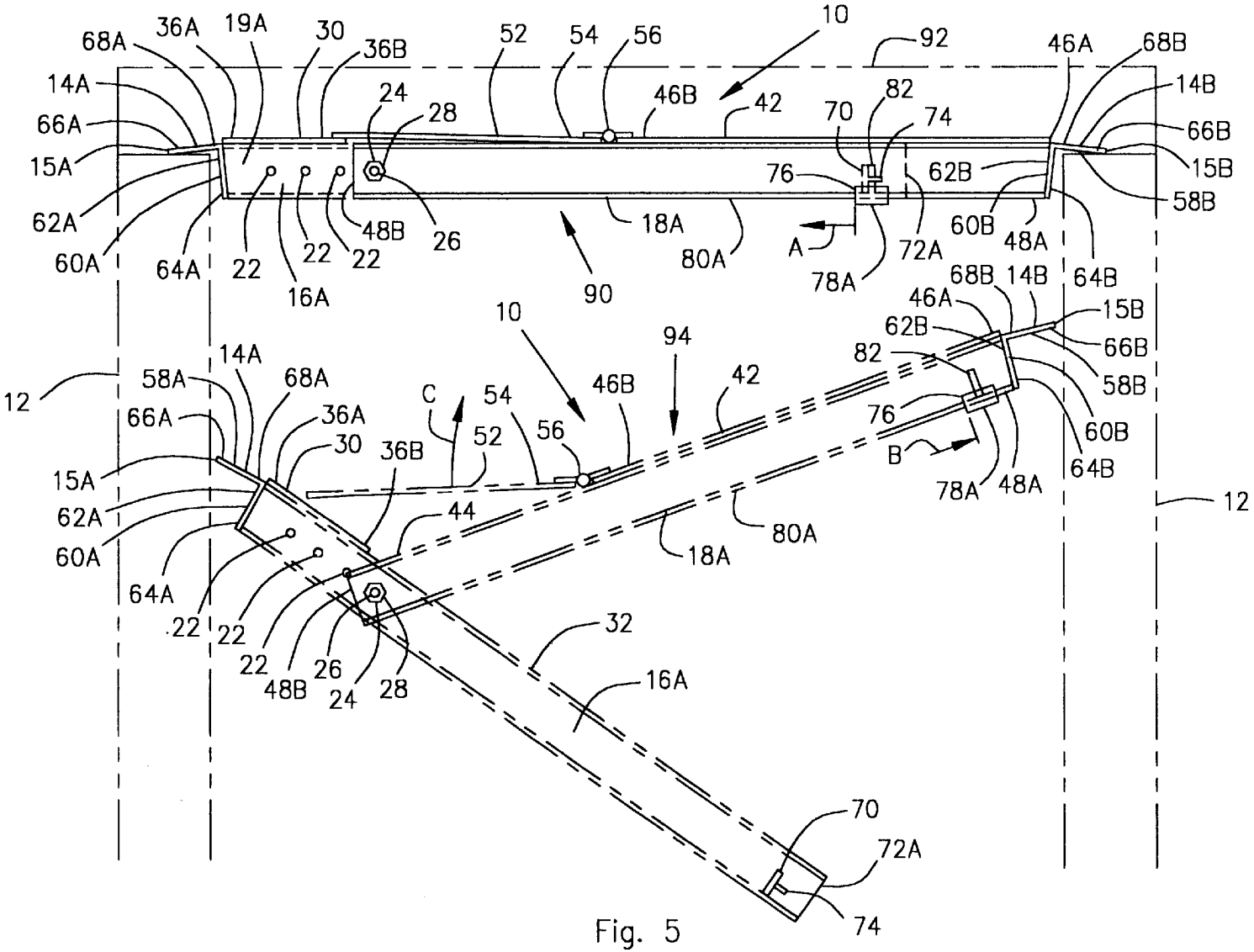
FIG. 5 is a side view of the reusable concrete support frame of FIG. 1 and the same frame is shown in outline illustrating how the frame is removed from the two horizontal support beams after concrete has been poured on the top of the frame.

As shown in the lower portion of FIG. 5A, first plate 30 is welded or permanently secured to top surfaces 32 of the first channel irons 16A and 16B so that the first plate 30 extends to the first angle iron end member 14A on one end 36A of the first plate 30 and extends just above where the bolt openings 22 are provided in the first channel irons 16A and 16B on the other end 36B of the first plate 30, as illustrated in FIG. 5.

Figure 2:
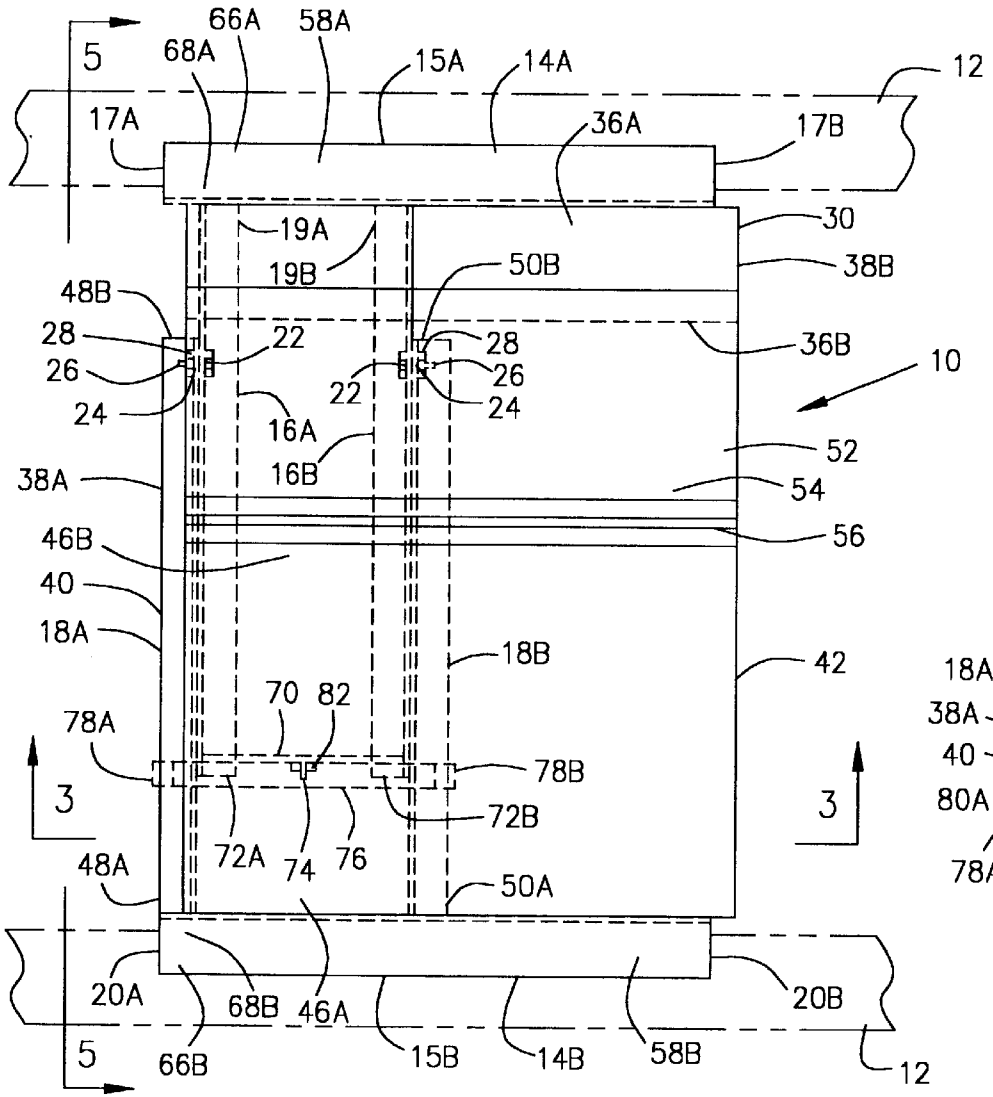
FIG. 2 is a top plan of the reusable concrete support frame of FIG. 1.

Referring to FIG. 2, the first plate 30 extends on one side 38A of the frame 10 so that it is slightly beyond one of the first channel irons 16A but not as far as the first end 17A of the first angle iron end member 14A. The first end 17A of the first angle iron end member 14A and the outside edge 40 of the one of the second channel irons 18A are flush with each other. Also the first end 17A of the first angle iron end member 14A is flush with the first end 20A of the second angle iron end member 14B.

The first plate 30 extends on an opposite side 38B of the frame 10 so that it is slightly beyond the second end 17B of the first angle iron end member 14A. The second end 17B of the first angle iron member 14A and the second end 20B of the second angle iron member 14B are flush with each other, as illustrated in FIG. 2.

Also illustrated in the lower portion of FIG. 5, second plate 42 is welded or permanently secured to top surfaces 44 of the second channel irons 18A and 18B so that the second plate 42 extends to the second angle iron end member 14B on one end 46A of the second plate 42, and extends approximately midway between the ends 48A and 48B of the second channel iron 18A and approximately midway between the ends 50A and 50B of the second channel iron 18B on the other end 46B of the second plate 42, as illustrated in FIGS. 2 and 5.

Referring to FIG. 2, the second plate 42 extends on one side 38A of the frame 10 so that it is flush with the first plate 30 and extends on an opposite side 38B of the frame 10 to so that it is flush with the first plate 30 on side 38B, also.

A third plate 52 is pivotally secured on its proximal end 54 to end 46B of the second plate 42 opposite to the end 46A of the second plate 42 that secures to the second angle iron end member 14B. The third plate 52 attaches to the second plate 42 by a hinge 56 so that the third plate 52 can swing upward when the frame 10 is removed from the horizontal supporting beams 12, as illustrated in the lower portion of FIG. 5 by Arrow C. As illustrated in the upper portion of FIG. 5, the third plate 52 slightly overlaps the first plate 30. Thus the three plates 30, 42, and 52 form a flat upper surface onto which concrete can be poured when the frame 10 is in its locked horizontal position 90, as illustrated in FIG. 1 and in the upper portion of FIG. 5.

Referring to FIG. 2, the third plate 52 extends on side 38A of the frame 10 so that it is flush with the both the first and second plates 30 and 42 and extends on opposite side 38B of the frame 10 to so that it is also flush on side 38B with both the first plate 30 and the second plate 42.

As illustrated in FIG. 5, each of the two angle iron end members 14A and 14B is attached to the frame 10 so that a first leg 58A and 58B of each of the angle irons members 14A and 14B is extending outward away from the frame 10 and angled slightly downward and the other second leg 60A and 60B of each of the angle iron members 14A and 14B extends downward and slightly off perpendicular, with a proximal end 62A and 62B of the second leg 60A and 60B extending from the frame 10 slightly further than a distal end 64A and 64B of the same leg 60A and 60B.

This angled arrangement of the two angle iron end members 14A and 14B causes distal ends 66A and 66B of the first legs 58A and 58B of the two angle iron end members 14A and 14B to engage the horizontal supporting beams 12 at either end 15A and 15B of the frame 10 and allows a proximal end 68A and 68B of the first legs 58A and 58B to be slightly elevated above the horizontal supporting beam 12. This angled arrangement also allows the distal ends 64A and 64B of the second legs 60A and 60B to be spaced apart from the horizontal supporting beams 12 when the frame 10 is resting on the horizontal supporting beams 12. The spaces between the angle iron end members 14A and 14B at the proximal end 68A and 68B of the first leg 58A and 58B and at the distal end 64A and 64B of the second legs 60A and.60B provides the necessary room for the frame 10 to be removed from between the horizontal supporting beams 12 and the concrete slab 92 that will eventually be poured on top of the plates 30, 42, and 52 of the frame 10, as illustrated in outline in the lower half of FIG. 5.

Figure 4:
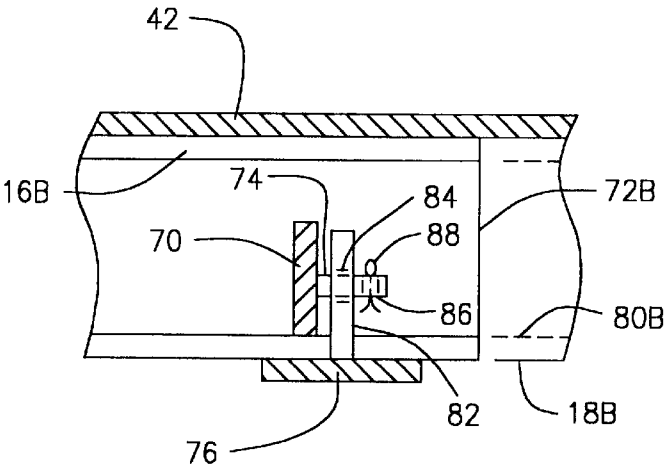
FIG. 4 is an enlarged cross sectional view taken along line 4—4 of FIG. 3.

As illustrated in FIG. 2, a horizontal bar 70 is welded or otherwise permanently attached between the first channel irons 16A and 16B at a second end 72A and 72B of the first channel irons 16A and 16B. As shown in detail in FIG. 4, the horizontal bar 70 is provided with a rod 74 that extends outward toward the second angle iron end member 14B and parallel with the first channel irons 16A and 16B.

Figure 3:
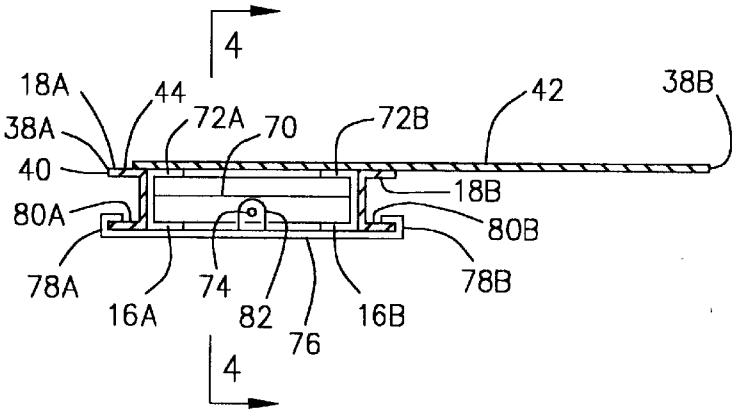
FIG. 3 is a cross sectional view taken along line 3—3 of FIG. 2.

As illustrated in FIG. 3, a sliding lock bar 76 extends between the second channel irons 18A and 18B and is movable longitudinally along the second channel irons 18A and 18B, i.e. movably in a direction parallel to the second channel irons 18A and 18B, as indicated by arrows A and B in FIG. 5. The sliding lock bar 76 is provided with two unshaped arms 78A and 78B that slidably engage the outwardly extending lower arms 80A and 80B of the second channel irons 18A and 18B so the sliding lock bar 76 travels along and parallel to the second channel irons 18A and 18B between the second angle iron end member 14B and the first channel irons 16A and 16B. The sliding lock bar 76 is provided with a tab 82 that extends upward and has an rod receiving opening 84 therein for removably receiving the rod 74 provided on the horizontal bar 70. In order to lock the frame 10 so that the pair of channel irons 16A and 18A and the pair of channel irons 16B and 18B can not pivot at the bolts 26, the sliding lock bar 76 is moved toward the first angle iron end member 14A, as indicated by Arrow A in FIG. 5, until the rod 74 enters the rod receiving opening 84 in the tab 82 of the sliding lock bar 76. With the rod 74 in this position, all the channel irons 16A, 16B, 18A, and 18B must remain parallel with each other and the frame 10 can not pivot. The rod 74 is provided with a locking opening 86 therein through which a cotter pin 88 or similar locking device can be removably inserted to lock the rod 74 within the rod receiving opening 84 of the tab 82 as a safety precaution against accidental pivoting release of the frame 10.

USE OF THE INVENTION

As illustrated in FIG. 2 and at the top of FIG. 5, the bolts 26 of the frame 10 are placed in the appropriate bolt openings 22 so that the frame 10 is the proper length to enable the two angle iron end members 14A and 14B to reach between the horizontal supporting beams 12 so that the frame 10 extends over the area between the horizontal supporting beams 12 where concrete is to be poured. Although not illustrated, at an actual construction site, several frames 10 are positioned side by side on the horizontal supporting beams 12 so that the frames 10 overlap slightly, i.e. the plates 30, 42, and 52 of one frame 10 rest on the second channel irons 18A and 18B of the adjacent frame 10 forming a continuous floor onto which concrete can be poured. Each frame 10 is placed in a locked horizontal position 90, as illustrated in FIG. 1 and in the upper portion of FIG. 5, by moving the sliding lock bar 76 so that the rod 74 enters the rod receiving opening 84 in the tab 82 of the associated sliding lock bar 76. A cotter pin 88 is then inserted into the locking opening 86 to lock the rod 74 within the rod receiving opening 84 of the tab 82, and thereby locking the frame 10 in its locked horizontal position 90 so that concrete can be poured.

Once the concrete has hardened sufficiently, each of the frames 10 will be unlocked by disengaging the cotter pin 88 from the rod 74, and moving the sliding lock bar 76 toward the second angle iron end member 14B, thus allowing the pair of channel irons 16A and 18A and the pair of channel irons 16B and 18B to pivot-at the bolts 26. As illustrated in the lower portion of FIG. 5, each of the frames 10 pivot in their unlocked position 94 and they drop downward, disengaging from the concrete slab 92 and from the horizontal supporting beams 12 on which the concrete slab 92 rests. The frames 10 are then ready for reuse.

While the invention has been described with a certain degree of particularity, it is manifest that many changes may be made in the details of construction and the arrangement of components without departing from the spirit and scope of this disclosure. It is understood that the invention is not limited to the embodiments set forth herein for the purposes of exemplification, but is to be limited only by the scope of the attached claim or claims, including the full range of equivalency to which each element thereof is entitled.

What is claimed is:

1. A reusable concrete support frame comprising:

at least two spaced apart and approximately parallel inner support members secured on one of their ends to an outwardly extending lip so that the inner support members are approximately perpendicular to the lip, at least two spaced apart and approximately parallel outer support members secured on one of their ends to an second outwardly extending lip so that the outer support members are approximately perpendicular to the lip, the inner support members pivotally secured between the outer support members so that the first and second lips articulate relative to each other when the inner and outer support members pivot relative to each other, means to reversibly lock the inner and outer support members in a horizontal position so that the support members are approximately parallel to each other and do not articulate relative to each other, at least one plate secured to at least one support member to provide an upper surface onto which concrete can be poured, said lips provided at two opposite ends of the supporting members for removably engaging a supporting beam when the frame is locked in a horizontal position, each lip being slightly tilted for suspending the supporting members between two spaced apart supporting beams, a horizontal bar extending between and secured to second ends of the inner supporting members, a lock bar slidably secured to the outer support members so that it reversibly engages the horizontal bar to lock the supporting members in a horizontal position, a rod provided on said horizontal bar, a rod receiving opening provided in a tab on said lock bar, said rod removably inserting into the rod receiving opening as a means of preventing said lock bar from disengaging said horizontal bar.

2. A reusable concrete support frame according to claim 1 further comprising:

a locking opening provided in said rod, a locking pin removably insertable in the locking opening as a means of preventing said rod from disengaging the rod-receiving opening in the tab of the lock bar.

3. A reusable concrete support frame comprising:

at least two spaced apart and approximately parallel inner support members secured on one of their ends to an outwardly extending lip so that the inner support members are approximately perpendicular to the lip, at least two spaced apart and approximately parallel outer support members secured on one of their ends to an second outwardly extending lip so that the outer support members are approximately perpendicular to the lip, the inner support members pivotally secured between the outer support members so that the first and second lips articulate relative to each other when the inner and outer support members pivot relative to each other, means to reversibly lock the inner and outer support members in a horizontal position so that the support members are approximately parallel to each other and do not articulate relative to each other at least one plate secured to at least one support member to provide an upper surface onto which concrete can be poured, and at least one plate pivotally attached to at least one support member so that the plate pivots when the support members pivot relative to each other.

* * * * *